US005778293A

United States Patent [19]

Ohtsuka

[11] Patent Number: 5,778,293

[45] Date of Patent: Jul. 7, 1998

[54] IMAGE HEATING APPARATUS

[75] Inventor: Yasumasa Ohtsuka, Yokohama, Japan

[73] Assignee: Canon Kabushiki Kaisha, Tokyo, Japan

[21] Appl. No.: 656,428

[22] Filed: May 30, 1996

Related U.S. Application Data

[62] Division of Ser. No. 323,789, Oct. 17, 1994, Pat. No. 5,568,240.

[30] Foreign Application Priority Data

Oct. 18, 1993 [JP] Japan ..... 5-259972

[51] Int. Cl.[6] ..... G03G 15/20

[52] U.S. Cl. ..... 399/329; 219/216; 219/619; 399/328

[58] Field of Search ..... 355/285, 282, 355/289, 290, 291, 286–287; 219/619, 667, 662, 670–671, 469–471, 216; 399/328, 329, 330, 331, 335, 341

[56] References Cited

U.S. PATENT DOCUMENTS

| | | | |
|---|---|---|---|
| 4,570,044 | 2/1986 | Kobayashi et al. | 219/469 X |
| 4,912,514 | 3/1990 | Mizutani . | |
| 5,074,019 | 12/1991 | Link | 219/470 X |
| 5,177,549 | 1/1993 | Ohtsuka et al. . | |
| 5,204,723 | 4/1993 | Hanada et al. | 355/285 |
| 5,210,580 | 5/1993 | Aslam et al. | 355/290 |
| 5,249,949 | 10/1993 | Aslam et al. | 355/290 X |
| 5,278,618 | 1/1994 | Mitani et al. | 355/285 |
| 5,331,385 | 7/1994 | Ohtsuka et al. . | |
| 5,552,582 | 9/1996 | Abe et al. | 219/619 |
| 5,568,240 | 10/1996 | Ohtsuka | 399/335 |
| 5,621,510 | 4/1997 | Okuda et al. | 399/338 |

FOREIGN PATENT DOCUMENTS

| | | | |
|---|---|---|---|
| 488357 | 6/1992 | European Pat. Off. . | |
| 3314665 | 4/1983 | Germany . | |
| 57-205766 | 12/1982 | Japan | 219/619 |
| 61-261763 | 11/1986 | Japan . | |
| 62-150371 | 4/1987 | Japan . | |
| 4-306585 | 10/1992 | Japan | 219/619 |
| 4-306588 | 10/1992 | Japan | 219/619 |
| 5-9027 | 1/1993 | Japan . | |

*Primary Examiner*—Matthew S. Smith
*Attorney, Agent, or Firm*—Fitzpatrick, Cella, Harper & Scinto

[57] ABSTRACT

An image heating apparatus includes a movable member having an electrically conductive layer and movable with a recording material; an excitation coil for producing magnetic flux, which produces eddy current in the movable member to generate heat therein, and wherein an image on said recording material is heated by heat of the movable member; wherein the movable member has a low thermal conductivity material at a side nearer to said excitation coil than the conductive layer.

4 Claims, 4 Drawing Sheets

IMAGE HEATING APPARATUS

This application is a division of application Ser. No. 08/323,789, filed Oct. 17, 1994, now allowed U.S. Pat. No. 5,568,240.

FIELD OF THE INVENTION AND RELATED ART

The present invention relates to an image heating apparatus for heating an image using electromagnetic induction and eddy current more particularly to an image heating apparatus suitably usable for an image fixing apparatus for fixing an unfixed image in an image forming apparatus such as an electrophotographic apparatus or electrostatic recording apparatus or the like.

In such an apparatus, the heat is generated by flowing current through halogen lamp or heat generating resistor, and the toner is heated through a roller or film.

Japanese Patent Application Publication No. 9027/1993 proposes that eddy current produced in a cylindrical member by magnetic flux to produce Joule heat, thus producing heat in the cylindrical member.

By using the eddy current, the heat generating position can be made closer to the toner, and therefore, the warming up period can be reduced as compared with the heat roller type using halogen lamp.

However, in the Japanese Patent Application Publication No. 9027/1993, when the Joule heat is produced by the eddy current, the excitation coil and the excitation core are heated with the result of variation of the magnetic flux density, and therefore, the amount of heat generation is not stable.

If the temperature rise is large, the excitation coil is deteriorated.

Additionally, the thermal efficiency is not sufficient due to the irradiation into the inside of the cylindrical member.

SUMMARY OF THE INVENTION

Accordingly, it is a principal object of the present invention to provide an image heating apparatus in which the magnetic flux produced by the excitation coil is stabilized.

It is another object of the present invention to provide an image heating apparatus in which the excitation coil is prevented from deteriorating.

It is a further object of the present invention to provide an image heating apparatus having a high thermal efficiency.

It is a further object of the present invention to provide an image heating apparatus in which a movable member has a low thermal conductivity base member at a position closer to the excitation coil than the conductive layer.

It is a further object of the present invention to provide an image heating apparatus in which an excitation coil is opposed to a nip formed between a movable member and a pressing member.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Referring to the accompanying drawings, the embodiments of the present invention will be described in detail.

Figure 3:
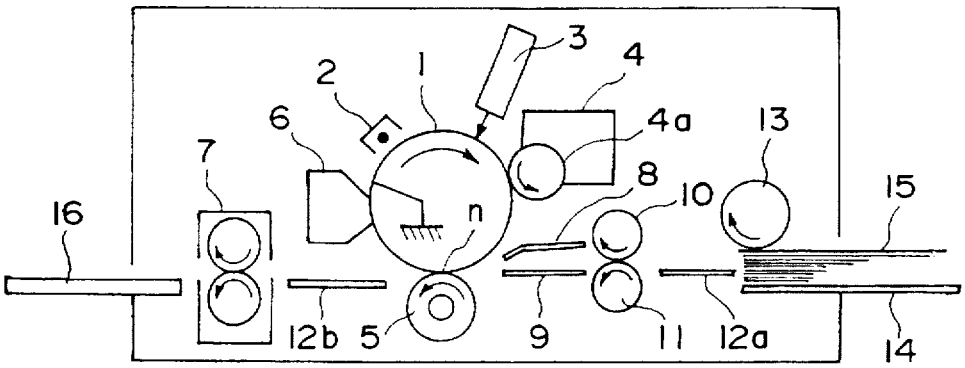
FIG. 3 is a sectional view of an image forming apparatus according to an embodiment of the present invention.

FIG. 3 is a sectional view of an image forming apparatus using an image heating apparatus according to an embodiment of the present invention as an image fixing apparatus.

Designated by a reference numeral 1 is an electrophotographic photosensitive member (photosensitive drum) of a rotatable drum type as a first image bearing member. The photosensitive drum 1 is rotated at a predetermined peripheral speed (process speed) in the clockwise direction indicated by an arrow, and during the rotation, it is uniformly charged by a primary charger 2 to a dark potential VD of the negative polarity and having a predetermined potential level.

Designated by reference numeral 3 is a laser beam scanner, and produces a laser beam modulated in accordance with time serial electric digital pixel signals representative of the intended image information supplied from a host apparatus such as unshown image reader, word processor, computer or the like. The surface of the photosensitive drum uniformly charged to the negative polarity by the primary charger 2 is exposed to a scanning laser beam, by which the absolute value of the potential of the exposed portion reduces to a light potential VL, so that an electrostatic latent image corresponding to the intended image information is formed on the surface of the rotating photosensitive drum 1.

Subsequently, the latent image is reverse-developed with powder toner charged to the negative polarity by the developing device into a visualized image (toner is deposited on the portion exposed to the laser beam).

The developing device 4 comprises a rotatable developing sleeve **4*a*, and the outer peripheral surface thereof is coated with toner charged to the negative polarity, and is faced to the surface of the photosensitive drum 1. The sleeve is supplied with a developing bias voltage VDC having a absolute value which is smaller than the dark potential VD of the drum 1 and is larger than the light potential VL, so that the toner transfers to the photosensitive drum only at the light potential VL portion of the photosensitive drum from the sleeve 4*a***, thus visualizing the latent image (reverse development).

A recording material 15 functioning as a second image bearing member is stacked on a sheet feeding tray 14, and is fed out one-by-one by a pick-up roller 13. It is further fed along sheet guide **12*a* and by a pair of registration rollers 10 and 11 and along transfer guides 8 and 9 into a nip (transfer position) n formed between the photosensitive drum 1 and a transfer roller 5 which is contacted to the photosensitive drum 1 and supplied with a transfer bias voltage from a voltage source. The feeding is synchronized with rotation of the photosensitive drum 1. Thus, the toner image is transferred from the photosensitive drum 1 onto the recording material 15. The transfer roller 5** as the transfer member has a volume resistivity of $10^8$–$10^9$ approximately.

The recording material 15 having passed through the transfer position is separated from the surface of the photosensitive drum 1, and is introduced into the fixing device 7 along the feed guide 12*b*, where the transferred toner image is fixed on the recording material, and then, it is discharged as a print onto a discharge tray 16. The surface of the photosensitive drum after the separation of the recording material is cleaned by the cleaning device 6, so that the residual matters are removed from the surface of the photosensitive drum to be prepared for the repeated use thereof.

The description will be made as to the fixing apparatus which is an image heating apparatus according to an embodiment of the present invention.

Figure 1:
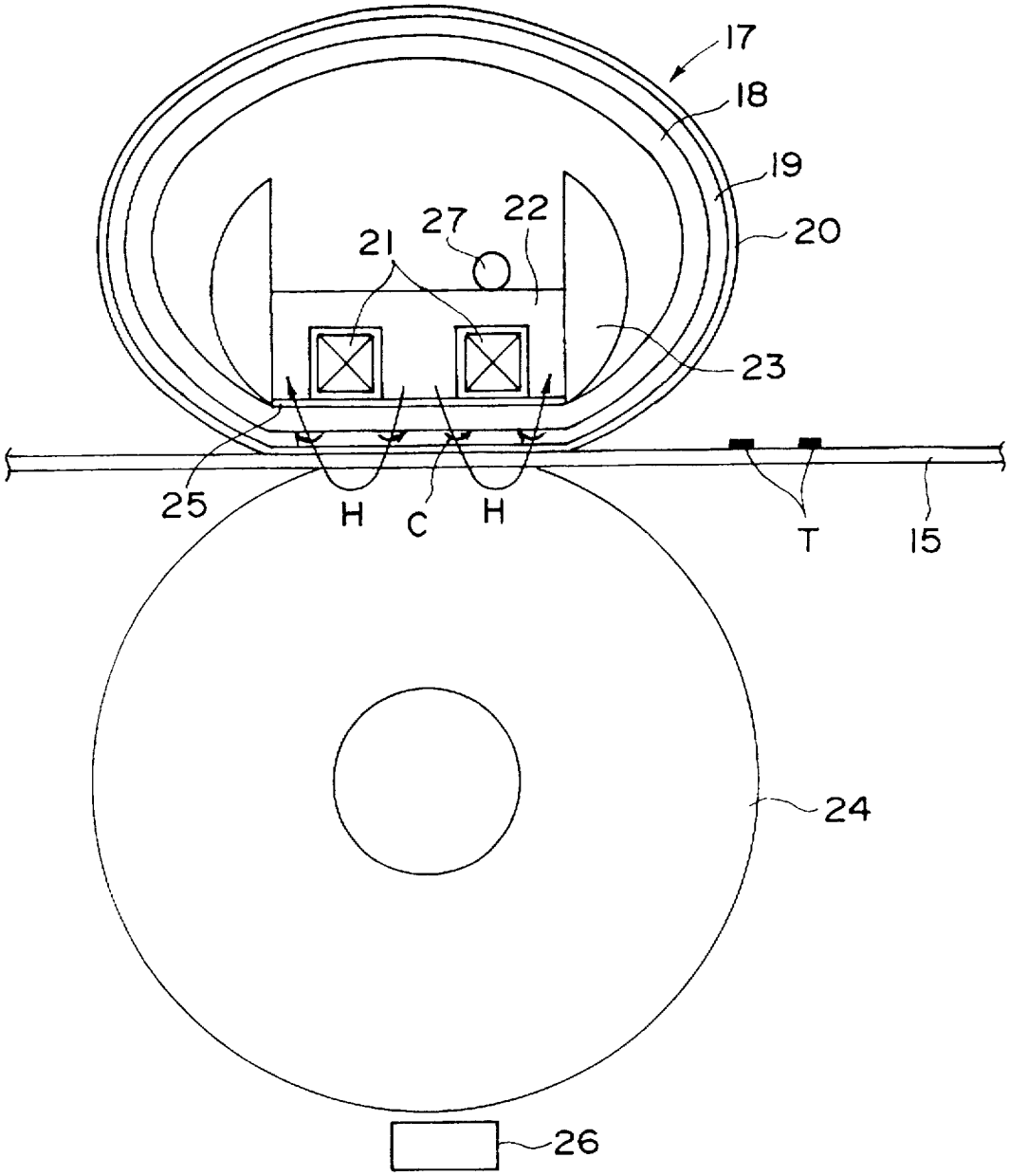
FIG. 1 is a sectional view of an image heating apparatus according to an embodiment of the present invention.

FIG. 1 is a sectional view of the fixing apparatus.

Designated by reference 17 is a movable film and comprises a low thermal conductivity base 18 of a resin material such as polyimide, polyamide imide, PEEK, PES, PPS, PFA, PTFE, FEP or the like and having a thickness of 10–100 μm, an electrically conductive layer 19, thereon, of Fe, Co or plated Ni, Cu, Cr or another metal with a thickness of 1–100 μm, and an outermost surface parting layer 20, thereon, of one or more resin materials having high heat resistivity and high parting property such as PFA, PTFE, FEP, silicone resin or the like. Designated by a reference numeral 21 is an excitation coil wound around an iron core 22 (core material). The core material 22 functions as a supporting member for the coil 21. A stay 23 functions to support the coil 21 and the core material 22 to maintain the travel of the film 17, and it is of liquid crystal polymer, phenol resin or the like.

A sliding plate 25 is stacked to the core material 22 at the position of contact with the film to guide the movement of the film at the nip. The sliding plate 25 is of glass or the like exhibiting low friction relative to the film 17, and it is preferable that the surface thereof is coated with grease or oil. Alternatively, the core metal 22 may be provided with a flat surface to constitute the sliding portion. A pressing roller 24 comprises a core metal coated with silicone rubber, fluorine rubber or the like.

The pressing roller 24 cooperates with a support (core member 22, stay 23 or the like) for supporting the coil 21 to form a nip with a film 17 therein. The coil 21 is disposed at a position opposed to the nip.

The pressing roller 24 is driven by an unshown driving mechanism, so that the film 17 is rotated by the pressing roller.

The recording material carrying an unfixed toner image is fed by the nip between the film 17 and the pressing roller 24, by which the recording material 15 is heated and pressed to fuse and fix the toner image.

The coil 21 is supplied with an alternating current having changing current from the excitation circuit, so that the magnetic flux density indicated by an arrow H around the coil 21 is generated and disappeared. The magnetic flux H extends across the conductive layer of the film 17 because of the provision of the core metal 22. When the changing magnetic field crosses an electroconductive member, an eddy current is produced in the conductive member so as to produce a magnetic field impeding the change of the magnetic field. The eddy current is indicated by an arrow C.

The eddy current I is concentrated at the coil (21) side surface of the conductive layer because of the skin effect, and produces heat with the power proportional to the skin resistance RS of the electroconductive layer of the film. The skin resistance RS is expressed:

$$RS = \rho/\delta = \sqrt{\omega\mu\rho/2}$$

where ω is an angular frequency of the electric field, μ is a magnetic permeability of the electroconductive layer, ρ is a specific resistance, and $$\delta = \sqrt{2\rho/\omega\mu}$$

The electric power P in the conductive layer 19 is, $$P \alpha RS \int |If|^2 dS$$

where If is a current flowing through the film.

As will be understood, the electric power can be increased if RS or |f is increased, so that the heat generation can be increased.

In order to increase the resistance RS, the frequency ω is increased, or the magnetic permeability μ or the specific resistance ρ is increased by selection of the material.

From the above it is considered that if the conductive layer 19 is of non-magnetic metal, the heat generation is difficult. However, if the thickness t of the conductive layer 19 is thinner than the skin depth δ, the following results:

$$RS = \rho/t$$

therefore, the heating is possible depending on the thickness t.

The frequency of the alternating current applied to the excitation coil 21 is preferably 10–500 kHz.

If it is higher than 10 kHz, the absorption efficiency into the conductive layer is good, and an excitation circuit can be constituted using a relatively inexpensive elements if it is not higher than 500 kHz.

Furthermore, if it is not less than 20 kHz, it is above the audible range, and therefore, the noise during electric power supply can be avoided. If it is not more than 200 kHz, the electric power loss in the excitation circuit is low, and the irradiation of the noise to the ambience is low.

When an alternating current of 10–500 kHz is supplied to the conductive layer, the skin depth or thickness is several microns to several hundreds microns.

If the thickness of the electroconductive layer is smaller than 1 μm, most of the electromagnetic energy is not absorbed by the electroconductive layer 19, and therefore, the energy efficiency is poor. Therefore, from the standpoint of the energy efficiency, the thickness of the conductive layer is not less than 1 μm, and not more than the depth of the skin, preferably.

Additionally, if the thickness is smaller than 1 μm, another problem that the leaked magnetic field produces heat in the other metal. On the other hand, if the thickness of the conductive layer 19 exceeds 100 μm, the film rigidity is too high, and the heat conduction area in the conductive layer is too long to heat the parting layer 20 quickly. For these reasons, the thickness of the conductive layer is preferably 1–100 μm.

In order to increase the heat generation of the conductive layer 19, If may be increased. For this purpose, the magnetic flux produced by the coil is strengthened, or the change of the magnetic flux is increased.

For this reason, it is preferable that the number of coil windings is increased, or the core metal 22 of the coil is a material having a high magnetic permeability and low residual magnetic flux density such as ferrite or permalloy.

Figure 2:
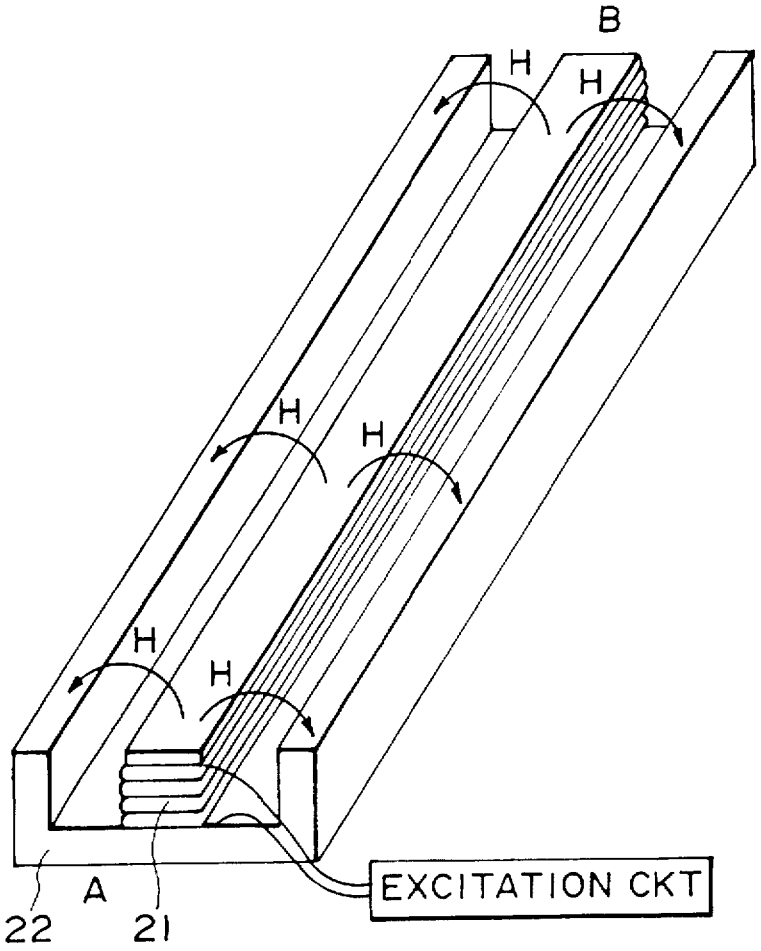
FIG. 2 is a perspective view of an excitation coil and a core material used in the embodiment of FIG. 1.

As shown in FIG. 2, in this embodiment, the excitation coil 21 is wound along the longitudinal direction of the nip which is substantially perpendicular to the film movement direction, around the excitation core metal 22 having "E" cross-section.

Adjacent the ends A and B, the magnetic flux is concentrated with the result of increased heat generation to compensate for the escape of the heat at the end portions.

A thermister 26 functions to sense the surface temperature of the pressing roller, and in response to the temperature detected by the thermister 26, the electric current supplied to the coil 21 is controlled.

When the pressing roller 24 is cool, and therefore, the thermister 26 detects low temperature, the duty ratio of the electric power supply is increased, and when the detected temperature is high, on the contrary, the duty ratio of the electric power supply is reduced.

The thermister may be provided on the core metal 22 or the non-sliding surface of the sliding plate 25.

Designated by reference numeral 27 is a safety element such as temperature fuse, thermoswitch or the like to shut off the electric power supply to the coil 22 upon overheating.

If the resistance of the conductive layer 19 is too low, the heat generation efficiency of the eddy current is reduced, and therefore, the specific volume resistivity of the conductive layer 19 is not less than $1.5\times10^{-8}$ ohm.cm under 20° C. ambience.

As described above, the heat is directly generated adjacent the surface conductive layer of the film, and therefore, the quick heating is possible, irrespective of the thermal conductivity or thermal capacity of the base member of the film nearer to the coil than the conductive layer. In addition, it is not influenced by the thickness of the film base, and therefore, the quick heating to the fixing temperature is possible, even if the thickness of the film base is increased in order to increase the rigidity of the film for the purpose of high speed image fixing.

Since the film base material is of low thermal conductivity resin, and therefore, it exhibits high thermal insulation property. Therefore, the heat insulation from a large thermal capacity member such as coil or the like inside the film can be effected. This permits low thermal loss even in the continuous printing, and therefore, high energy efficiency is accomplished. Additionally, the heat is not transmitted to the coil in the film, and therefore, the magnetic flux density can be stabilized, without the deterioration of the coil performance.

Corresponding to the improvement of the thermal efficiency, the temperature rise in the apparatus is suppressed, thus reducing the adverse influence to the image forming station in an electrophotographic machine.

In this embodiment, the coil is disposed faced to the nip, and therefore, the toner can be heated substantially simultaneously with the generation of heat in the film, thus increasing the thermal efficiency.

In the foregoing embodiment, the conductive layer 19 of the film 17 is produced by plating, but vacuum evaporation, sputtering or the like are usable in place of the plating.

By doing so, the electroconductive layer may be of aluminum or metal oxide alloy, which are not suitable for plating treatment.

In order to provide 1–100 μm layer thickness, however, the plating is preferable because such a thickness can be easily obtained.

If the use is made with ferromagnetic material such as high magnetic permeability iron, cobalt, nickel or the like, the electromagnetic energy produced by the coil 21 is easily absorbed, so that heating efficiency is improved. Additionally, the magnetic field leaking outside can be reduced, thus reducing the influence to the peripheral parts. Among these materials, high resistivity material is further preferable.

As for the electroconductive layer 19, the use may be made with not only a metal but also a bonding material for bonding the surface parting layer to the low thermal conductivity base material, in which high electroconductivity; high magnetic permeability particles or whiskers are dispersed.

Electroconductive particles such as carbon particles are mixed with manganese, titanium, chromium, iron, copper, cobalt, nickel or the like particles, or particles or whiskers of ferrite comprising the above material or an oxide, and the mixture is dispersed in the bonding material, to constitute the electroconductive layer.

Figure 4:
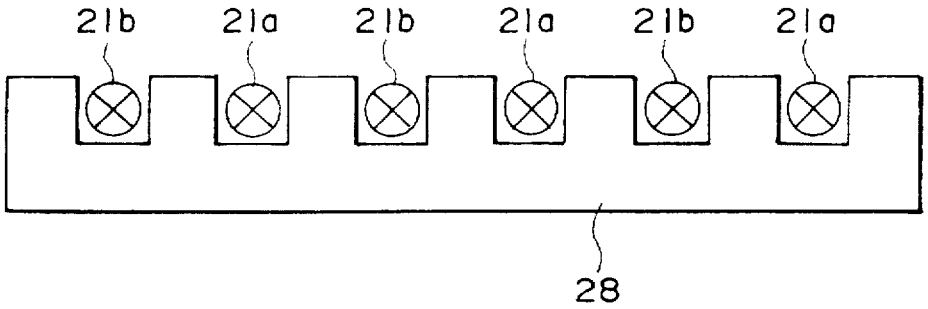
FIG. 4 is a sectional view of a coil and core metal according to a further embodiment of the present invention.

Referring to FIG. 4, another embodiment of the present invention will be described. The fundamental structure is the same as with the first embodiment, and the description will be limited to the different portions.

Figure 5:
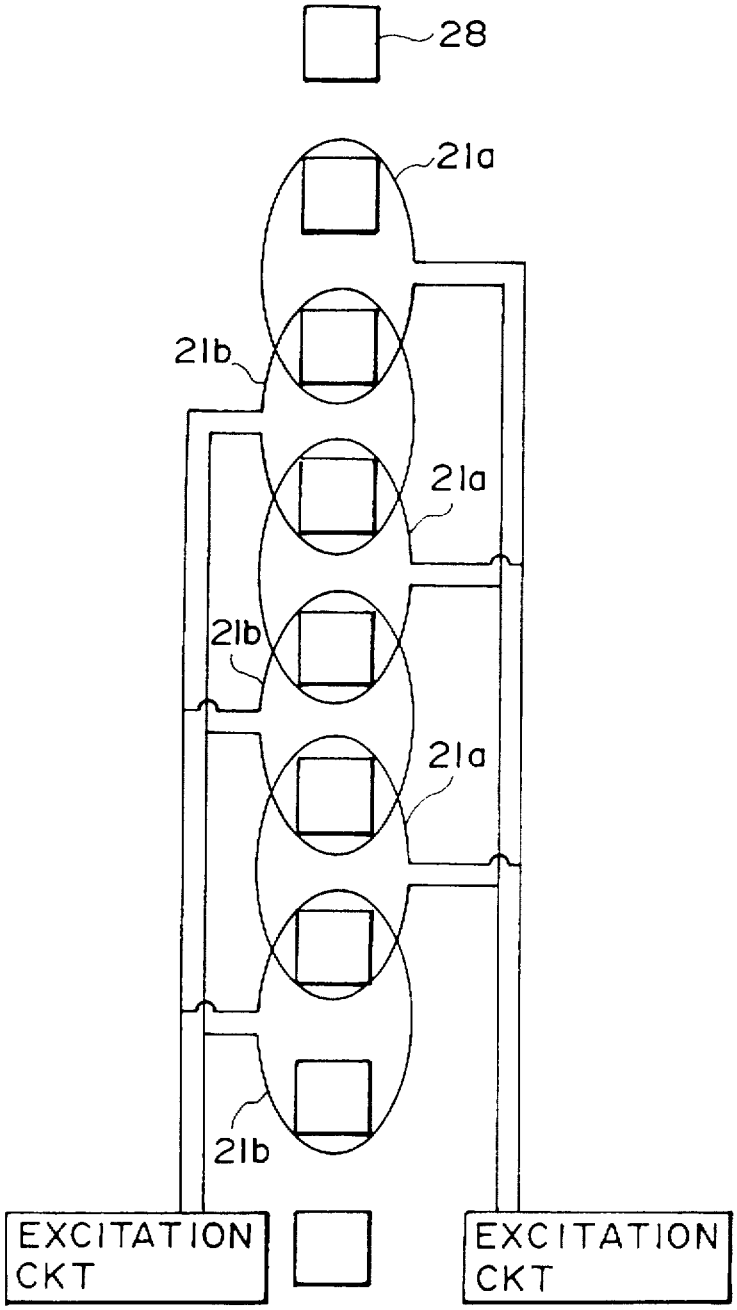
FIG. 5 schematically shows an apparatus using the elements of FIG. 4.

FIG. 4 is a longitudinal sectional view. In the Figure, the film is at an upper position. FIG. 5 is a schematic top plan view, wherein coils 21*a* and 21*b* are wound around a core metal 28 in a staggered manner. The coils 21*a* and 21*b* are supplied with high frequency waves which are different by $\pi/2$ in the phase, thus producing magnetic field finely changing in the longitudinal direction, by which the heat generation distribution in the film 17 is uniformed.

In the foregoing two embodiments, the direction of the magnetic field extends perpendicularly to the film, but the magnetic field may be imparted into the conductive layer 19 parallel to the surface of the layer from an external coil.

When a magnetic material having a Curie temperature suitable for the image fixing temperature, as the material for the electroconductive layer, the thermal energy is contributable to the increase of the internal energy of the electroconductive layer when the temperature approaches the Curie temperature with the result that the magnetic flux absorption ratio of the conductive layer is deteriorated to retard the heat generation. By this, the self temperature control is possible. When the Curie temperature is exceeded, the spontaneous magnetization disappears, by which the magnetic field produced in the electroconductive layer 19 reduces by the decrease of the Curie temperature, so that the eddy current further reduces to suppress the heat generation to permit the self temperature control. The Curie point is preferably 100°–250° C., preferably 100°–200° C. in conformity with the toner fusing point.

Alternatively, in consideration with the fact that the resultant inductance of the coil 21 and the film 17 significantly changes in the neighborhood of the Curie temperature, the temperature is detected at the excitation circuit supplying the high frequency wave to the coil 21 is detected, and on the basis of the detection the temperature control may be carried out.

As the material of the core metal 22 of the coil 21, it is preferably a magnetic material exhibiting low Curie temperature. For example, in case that the heat control becomes unable (runaway) and that the sheet feeding operation stops, the temperature of the core metal 22 starts to increase. As a result, as seen from the circuit for producing the high frequency wave, it is as if the inductance of the coil 21 is increased, and therefore, a control circuit for controlling the frequency, if it is provided, the control circuit increases more and more the frequency, with the result that the energy is consumed in the form of electric power loss of the excitation circuit. Then, the energy supplied to the coil 21 reduces, and the runaway stops. Specifically, the Curie point is preferably selected as being 100°–250° C.

If it is lower than 100° C., the temperature is lower than the fusing point of the toner, and even if the inside of the film is thermally insulated by the low thermal conductivity base material, the temperature of the core metal reaches to such a temperature due to the heat generation of the electroconductive layer, so that the runaway relatively easily occurs. If the temperature is above 250° C., the prevention of the runaway is not expected.

In the foregoing embodiment, the description has been made with respect to the heating with the use of the film, but a heat roller using a core material of low thermal conductivity resin material.

However, since a high magnetic flux density can be provided if the conductive layer is close to the excitation coil, and therefore, the film heating type using thin low thermal conductivity base material is preferable.

While the invention has been described with reference to the structures disclosed herein, it is not confined to the details set forth and this application is intended to cover such modifications or changes as may come within the purposes of the improvements or the scope of the following claims.

What is claimed is:

1. An image heating apparatus comprising:

an endless film having a metal layer;

an excitation coil for producing magnetic flux, which produces eddy current in said film to generate heat therein, and wherein an image on said recording material is heated by heat from said film; and a guiding member for guiding said film, wherein said film is extended around said guiding member, and a part of said film is tension-free.

2. An apparatus according to claim 1, wherein said metal layer is nickel.

3. An apparatus according to claim 2, wherein said metal layer is plated nickel.

4. An apparatus according to claim 1, further comprising a driving roller for cooperating with said guiding member to form a nip therebetween with said film therebetween, said driving roller is effective to rotate said film.

* * * * *

UNITED STATES PATENT AND TRADEMARK OFFICE

CERTIFICATE OF CORRECTION

PATENT NO. : 5,778,293

DATED : July 7, 1998

INVENTOR(S) : YASUMASA OHTSUKA

It is certified that error appears in the above-identified patent and that said Letters Patent is hereby corrected as shown below:

COLUMN 4

Line 14, "$P\cancel{d}RS\int/f//I^2dS$" should read --$P\cancel{d}RS\int/If/^2dS$--.

Signed and Sealed this

Twenty-third Day of February, 1999

*Attest:*

Q. TODD DICKINSON

*Attesting Officer*

*Acting Commissioner of Patents and Trademarks*